US010030398B2

(12) United States Patent
Byers et al.

(10) Patent No.: US 10,030,398 B2
(45) Date of Patent: Jul. 24, 2018

(54) NETWORK-ENABLED CEILING SUPPORT STRUCTURE

(71) Applicant: Cisco Technology, Inc., San Jose, CA (US)

(72) Inventors: Charles Calvin Byers, Wheaton, IL (US); John Allen Long, Jr., Santa Cruz, CA (US); Matthew A. Laherty, Bloomington, IN (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 14/643,463

(22) Filed: Mar. 10, 2015

(65) Prior Publication Data

US 2016/0265224 A1 Sep. 15, 2016

(51) Int. Cl.

| | |
|---|---|
| ***E04B 9/00*** | (2006.01) |
| ***E04B 9/06*** | (2006.01) |
| ***E04G 23/00*** | (2006.01) |
| ***H01R 25/14*** | (2006.01) |
| ***E04B 9/02*** | (2006.01) |

(52) U.S. Cl.

CPC ..... *E04G 23/00* (2013.01); *E04B 9/02* (2013.01); *E04B 9/06* (2013.01); *H01R 25/14* (2013.01); *E04B 9/006* (2013.01)

(58) Field of Classification Search

CPC ... E04B 9/006; E04B 9/06; E04B 9/10; H01R 25/16; H01R 25/14

See application file for complete search history.

(56) References Cited

U.S. PATENT DOCUMENTS 3,001,001 A * 9/1961 Bibb ..... E04F 17/08 174/500
3,590,135 A * 6/1971 Herbenar ..... H02G 3/281 174/491

(Continued)

OTHER PUBLICATIONS

"Fog Computing Is a New Concept of Data Distribution" published on Dec. 5, 2013 by CloudTweaks located at http://cloudtweaks.com/2013/12/fog-computing-is-a-new-concept-of-data-distribution/ (last accessed on Jun. 24, 2016).*

(Continued)

*Primary Examiner* — Charles A Fox
*Assistant Examiner* — Charissa Ahmad
(74) *Attorney, Agent, or Firm* — Polsinelli PC

(57) ABSTRACT

A ceiling support structure includes a plurality of network- and power-enabled rails that replace conventional structures for supporting a grid ceiling having a structure for supporting tiles and/or paneling. Each network-enabled rail comprises a plurality of connectors configured to receive a device or interface. At least some of the connectors can comprise a plurality of Power over Ethernet (PoE) connectors that provide both network connectivity and power to the devices. At least some of the connectors can comprise a plurality of fiber-optic cable connectors that provide network connectivity to the devices via the fiber-optic cable. In the fiber-optic cable connector structure, power is provided directly by the ceiling support itself which is formed of a conductive material and referred to as a power distribution bar. Each rail terminates at a hub referred to as a fog junction box that serves the power and networking for the ceiling support.

20 Claims, 7 Drawing Sheets

(56) References Cited

U.S. PATENT DOCUMENTS

| | | | | |
|---|---|---|---|---|
| 3,683,101 | A * | 8/1972 | Liberman | E04B 2/7453 174/491 |
| 3,931,452 | A * | 1/1976 | Nilsson | E04H 3/08 174/491 |
| 5,842,313 | A * | 12/1998 | Murray | H02G 3/00 174/491 |
| 6,515,224 | B1 * | 2/2003 | Pedro | H02G 3/0456 108/181 |
| 6,782,351 | B2 * | 8/2004 | Reichel | G01N 33/0075 340/501 |
| 7,351,075 | B1 * | 4/2008 | Patterson | H01R 25/142 439/121 |
| 9,145,678 | B1 * | 9/2015 | Wang | E04B 9/006 |
| 9,166,390 | B2 * | 10/2015 | Dean | H02G 3/0456 |
| 9,276,844 | B2 * | 3/2016 | Thubert | H04L 45/66 |
| 9,644,828 | B1 * | 5/2017 | May | F21V 7/00 |
| 2003/0021116 | A1 * | 1/2003 | Miller | F21S 8/00 362/249.01 |
| 2003/0207612 | A1 * | 11/2003 | McCoy | H01R 13/74 439/533 |
| 2006/0272256 | A1 * | 12/2006 | Frecska | E04B 9/006 52/506.07 |
| 2007/0123075 | A1 * | 5/2007 | Insalaco | H01R 13/6633 439/120 |
| 2007/0263855 | A1 * | 11/2007 | Martich | H01R 13/6641 379/413.04 |
| 2009/0053989 | A1 * | 2/2009 | Lunde | A61L 9/00 454/187 |
| 2009/0255203 | A1 * | 10/2009 | Richardson | E04B 9/06 52/506.06 |
| 2010/0229475 | A1 * | 9/2010 | Myers | E04B 9/006 52/173.1 |
| 2012/0204506 | A1 | 8/2012 | Whitfield | |
| 2016/0069554 | A1 * | 3/2016 | Ladstaetter | H01R 25/142 362/418 |

OTHER PUBLICATIONS

"Cisco unveils 'fog computing' to bridge clouds and the Internet of Things" published by Stephen Lawson on Jan. 29, 2014 by PCWorld located at http://www.pcworld.com/article/2092660/cisco-unveils-fog-computing-to-bridge-clouds-and-the-internet-of-things.html (last accessed on Jun. 24, 2016).*

Johnson Controls, Inc.; "Building Equipment and Systems," http://www.johnsoncontrols.com/content/latin_america/en/products/globalworkplacesolutions/services/building_equipment_systems.html; © 2015; accessed Mar. 10, 2015.

Daxten; "Busbar Power Distribution Systems—Overview," http://www.daxten.com/uk/busbar-power-distribution.html; accessed Mar. 10, 2015.

Armstrong; "DC FlexZone Systems," http://www.armstrong.com/commceilingsna/products/suspension_systems/dc-flexzone-systems/_/N-mZ1z141h7#; © 2000-2015; Access Mar. 10, 2015.

* cited by examiner

--Prior Art--

NETWORK-ENABLED CEILING SUPPORT STRUCTURE

TECHNICAL FIELD

The present technology pertains to ceiling support structures, and more specifically pertains to support structures for networked grid ceilings.

BACKGROUND

Modern carpeted spaces usually include a number of connected devices on their floors, walls, and especially ceilings that interface to data and/or power networks to manage the safety, security, convenience, and comfort of these rooms and their occupants. In this context, carpeted space refers to finished, environmentally controlled rooms in residential, governmental, and commercial buildings where people spend a significant amount of time, such as at work, at home, or in a hospital.

In some environments, there are certain regulatory requirements for the minimum connected devices serving these rooms, for example smoke detectors, emergency lights, or exit signs are often required at specific intervals within a building by building codes. There are amenities that occupants expect from the connected devices in a room, including minimum lighting levels, clocks, Wi-Fi networks, comfort features, etc. Building managers and owners also expect their carpeted spaces to be secure and energy efficient, and connected devices such as cameras, sensors and ventilation control dampers can help.

Unfortunately, it is often very expensive and time consuming to purchase, install and maintain multiple discrete networks required in a typical building. For example, the emergency lighting is on its own network, there is a wireless or wired data network, another network runs the clocks, etc. Installation of these multiple, independent parallel networks is expensive and time consuming. Further, if any change is required, multiple sets of technicians may need to visit the room (for example carpenter, electrician, networking specialist, all potentially unionized) to effect that simple change.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DESCRIPTION OF EXAMPLE EMBODIMENTS

Figure 1:
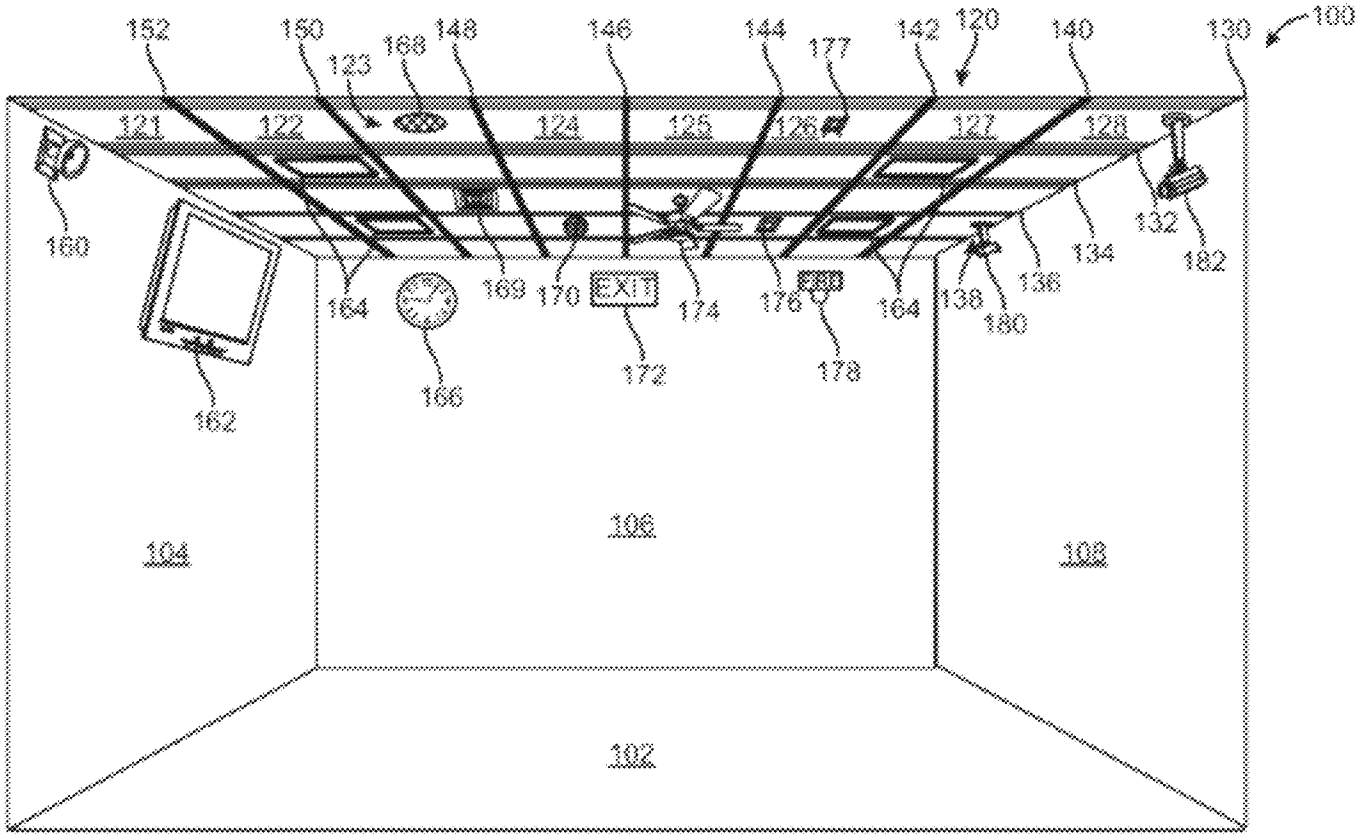
FIG. 1 illustrates an example carpeted space in accordance with the prior art.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Overview

A network-enabled ceiling support structure includes a plurality of network-enabled and power-enabled rails that replace conventional structures for supporting a ceiling, such as a dropped ceiling, an acoustic ceiling, or another ceiling space having a structure for supporting tiles and/or paneling. Each network-enabled rail comprises a plurality of connectors configured to receive a network-enabled device or interface. At least some of the connectors can comprise a plurality of Power over Ethernet (PoE) connectors that provide both network connectivity and power to the devices via the PoE connector. At least some of the connectors can comprise a plurality of fiber-optic cable connectors that provide network connectivity to the devices via the fiber-optic cable. In the fiber-optic cable connector structure, power is provided directly by the ceiling support itself which is formed of a conductive material and referred to herein as a "power distribution bar".

Each rail terminates at a hub referred to herein as a "fog junction box" that serves the power and networking for the ceiling support. The fog junction box includes a power supply fed from the AC main power supply. This power supply feeds the power injectors for the PoE lines, or drives the power distribution rails for the fiber-optic rail support. The fog junction box includes connectors that mate with the electrical or optical connectors of the ceiling support structure according to some aspects of the subject technology. The fog junction box also includes a fog processor and fog processing logic that controls connectivity and power of devices connected to each rail.

Connected devices of many types can be snapped over the rails at any position where there is an open connector. The devices can include some sort of alignment structure to insure their connectors mate correctly with the connectors on the bottom of the rails. Each device includes a retention latch to insure the connected device is securely attached to the rail. The retention latch can include a sensor to detect when the latch is released and indicate to the fog junction box that the device is going to be removed.

Description

A computer network is a geographically distributed collection of nodes interconnected by communication links and segments for transporting data between endpoints, such as personal computers and workstations. Many types of networks are available, with the types ranging from local area networks (LANs) and wide area networks (WANs) to overlay and software-defined networks, such as virtual extensible local area networks (VXLANs).

LANs typically connect nodes over dedicated private communications links located in the same general physical location, such as a building or campus. WANs, on the other hand, typically connect geographically dispersed nodes over long-distance communications links, such as common carrier telephone lines, optical lightpaths, synchronous optical networks (SONET), or synchronous digital hierarchy (SDH) links. LANs and WANs can include layer 2 (L2) and/or layer 3 (L3) networks and devices.

The Internet is an example of a WAN that connects disparate networks throughout the world, providing global communication between nodes on various networks. The nodes typically communicate over the network by exchanging discrete frames or packets of data according to predefined protocols, such as the Transmission Control Protocol/Internet Protocol (TCP/IP). In this context, a protocol can refer to a set of rules defining how the nodes interact with each other. Computer networks may be further interconnected by an intermediate network node, such as a router, to extend the effective "size" of each network.

Cloud computing can also be provided in one or more networks to provide computing services using shared resources. Cloud computing can generally include Internet-based computing in which computing resources are dynamically provisioned and allocated to client or user computers or other devices on-demand, from a collection of resources available via the network (e.g., "the cloud"). Cloud computing resources, for example, can include any type of resource, such as computing, storage, and network devices, virtual machines (VMs), etc. For instance, resources may include service devices (firewalls, deep packet inspectors, traffic monitors, load balancers, etc.), compute/processing devices (servers, CPU's, memory, brute force processing capability), storage devices (e.g., network attached storages, storage area network devices), etc. In addition, such resources may be used to support virtual networks, virtual machines (VM), databases, applications (Apps), etc.

Cloud computing resources may include a "private cloud," a "public cloud," and/or a "hybrid cloud." A "hybrid cloud" can be a cloud infrastructure composed of two or more clouds that inter-operate or federate through technology. In essence, a hybrid cloud is an interaction between private and public clouds where a private cloud joins a public cloud and utilizes public cloud resources in a secure and scalable manner. Cloud computing resources can also be provisioned via virtual networks in an overlay network, such as a VXLAN.

Fog computing is similar to cloud computing by having shared multi-use servers, storage and networking engines in a "cloud", except "fog" makes it more local by bringing it closed to the ground. A fog computational node is a localized cloud-like resource that includes processing, networking and storage at the level the network hierarchy and at a physical locality that makes the most sense for the subset of applications that are running on it. Fog computing is particularly useful for the Internet of Things (IoT), wherein large arrays of sensors, actuators, and other intelligent endpoints are connected to the network. Fog nodes can respond faster, using less bandwidth, and providing greater security and reliability than cloud-based computation models.

The disclosed technology addresses the need in the art for a single network connection type to provide in a carpeted space for the various devices. Disclosed are systems, methods, and computer-readable storage media for providing a network-enabled and power-enabled ceiling support system for a grid ceiling system. A brief introductory description of exemplary systems and networks, as illustrated in FIGS. 1 through 4, is disclosed herein. A detailed description of the ceiling support system, related concepts, and exemplary variations, will then follow. These variations shall be described herein as the various embodiments are set forth. The disclosure now turns to FIG. 1.

FIG. 1 illustrates an example carpeted space 100 in accordance with the prior art. Unfortunately, it is often very expensive and time consuming to purchase, install and maintain multiple discrete networks as shown in FIG. 1. This example carpeted space 100 is for an approximately 12-foot by 16-foot room in a modern office building. The carpeted space 100 comprises a floor 102, a first side wall 104 having a length of approximately 12 feet, a rear wall 106 having a width of approximately 16 feet and a second side wall 108 having a length of approximately 12 feet. Most of the connected devices serving the space are installed in or near the suspended ceiling 120. The ceiling can be a traditional suspended ceiling that receives tiles, an architectural ceiling, an acoustic ceiling, or any other grid ceiling having panels or another filler material in the space between the grid-type support structures. The suspended ceiling 120 includes five T-shaped rails 130, 132, 134, 136 and 138 that support a conventional ceiling tile, such as tiles 121, 122, 123, 124, 125, 126, 127 and 128 supported between rail 130 and rail 132 by cross-members 140, 142, 144, 146, 148, 150 and 152. The devices in the room include emergency lighting 160, digital signage 162, room lighting 164 within the ceiling tiles, a wall-mounted clock 166, a PA (public address) speaker 168, a ceiling ventilator 169, a smoke and/or fire detector 170, an exit sign 172, a ceiling fan 174, a humidistat and/or thermostat 176, a Wi-Fi (wireless fidelity) A.P. (access point) 177, a fire and/or evacuation alarm 178, an occupancy and/or motion detector 180 and a security camera 182.

The room lighting 164 can comprise individual trophers that can be controlled individually, for example for use in certain emergency modes. The smoke and fire detectors 170 can comprise or also include general air quality sensors to look for various toxins such as fire, smoke or carbon monoxide. It can also be a full weapons of mass destructions detector for detecting chemical, biological, nuclear, radiological and explosive toxins and send the appropriate signal to the fog junction box to which it is connected.

There are at least thirteen distinct devices shown in this example carpeted space, each requiring its own power connections, and most also requiring some sort of data or control network connections. These are exemplary devices, and many other types of sensors, actuators, displays can be used in addition to those shown. Installation of these multiple, independent, parallel networks is expensive and time consuming, probably costing over a thousand dollars for this space. Further, if any addition or change is desired (for example, moving the digital sign 162 from the first side wall 104 to the other side wall 108), multiple sets of technicians may need to visit the room. To effect such a simple change, multiple technicians may be needed, at the cost of several hundred dollars and several hours of room unavailability each time a simple change is needed or desired. For example, a carpenter to move the mount, an electrician to provide power, and a networking specialist to provide networking, all potentially unionized. Moreover, many overlay networks are required to provide the device functionalities, which are inefficient due to duplicated physical connections and effort to design, install and maintain them.

What is needed is a structure that allows for a simpler way to provide the carpeted space connected device functions shown in FIG. 1 using common networks. The new solution condenses the multiple discrete power, control and data networks serving these devices to a highly integrated network. The solution is safe for occupants of the space to reconfigure the connected devices themselves, moving them or changing their complement without significant expense.

According to several aspects of the subject technology, a new type of network-enabled ceiling support system is provided. In a traditional (prior art) suspended ceiling, a rectangular or square grid of ceiling supports ("rails") is snapped together (as shown in FIG. 1) and hung from the structure of a building. The spaces between these rails (typically either 2'×2' or 2'×4') are filled with ceiling sections, and contain mechanical features to accept and lock in end-to-end connections (130, 132, 134, 136 and 138 in FIG. 1) and the cross-beams (140, 142, 144, 146, 148, 150 and 152 in FIG. 1). These rails are typically made of rolled steel or aluminum, and have a profile resembling an inverted "T". The subject technology modifies these main rails to integrate power and data networking features in a dense grid of potential connection points for multiple types of intelligent devices.

Figure 2B:
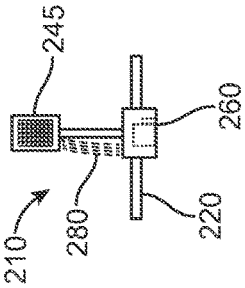
FIGS. 2A and 2B illustrate example side and end views of a network-enabled ceiling support system having Power over Ethernet (PoE) connectors, according to some aspects of the subject technology.
Figure 2A:
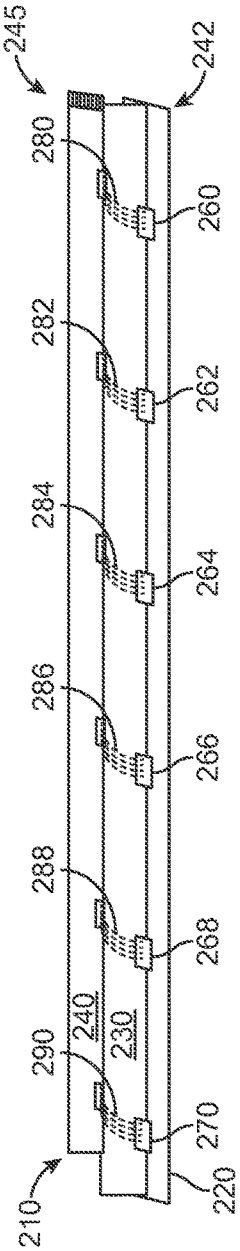

FIGS. 2A and 2B illustrate example side and end views, respectively, of an example network-enabled ceiling support system having power over Ethernet (PoE) connectors, according to some aspects of the subject technology. FIG. 2A depicts a side view of a suspended ceiling rail 210 in accordance with one embodiment of the subject technology. In this example embodiment, Power over Ethernet (PoE) technology is integrated into the ceiling support structure. The ceiling support rail 210 includes a base 220, a center upright portion 230 and a top cavity of the rail 240. In this example embodiment the support rail 210 is approximately 12-feet in length and includes six perforations that each accept a jack 260, 262, 264, 266, 268 and 270 proximate the base 220 of the ceiling support rail 210. In the example embodiment, these perforations can be placed at a distance of 1-foot, 3-feet, 5-feet, 7-feet, 9-feet and 11-feet from the end 242 of the rail 210. Different perforation spacing is also possible, such as 1-foot, 3-foot, 4-foot or 6-foot on center. Different rail lengths, such as rails having a length of 6-feet, 18-feet or 24-feet are likewise adaptable to the subject technology. Other perforation spacing and rail lengths can be implemented in accordance with the subject technology. Other embodiments showing different length of rails, spacing of perforations and number of perforations are shown and described herein.

The snap-in eight-conductor metallic cable jacks 260, 262, 264, 266, 268 and 270 are similar in structure and identical in performance to standard Category 5 and/or Category 7 (CAT-5/CAT-7) RJ-45 jacks. An RJ-45 connector is a standardized modular connector having eight conductors. There are eight wires from each jack (wires 280 for perforation 260, wires 282 for perforation 262, wires 284 for perforation 264, wires 286 for perforation 266, wires 288 for perforation 268 and wires 290 for perforation 270. The eight wires for each of the group of eight wires (280, 282, 284, 286, 288 and 290) are guided through and into a hollow space within the top cavity 240 of the rail 210. There are 48 conductors total, given that there are six jacks each carrying eight wires, and all 48 conductors are terminated at a single multi-signal connector 245 at the end 242 of the rail 210. Each jack has four pairs of twisted-pair wires to provide eight total. The wires provide both power and networking up to 1 Gb/s (Gigabit per second) and up to 10 Gb/s in some embodiments. Each of the six jack positions (260, 262, 264, 266, 268 and 270) is independently capable of supporting at least 1 Gb/s of bidirectional data, and almost 60 Watts of DC power delivery. This is sufficient power and network data capacity for a single jack to drive a display monitor or any other devices shown in FIG. 1, for example.

By guiding the wires through the hollow space in the top cavity 240 of the rail 210, it is possible to avoid the expense typically associated with wires running in the plenum, which is the space between the ceiling support rail and the floor above the carpeted space. Typically wires that are guided into the plenum above a dropped or suspended ceiling are required to be plenum-rated, meaning that they are specially coated and/or manufactured in accordance with code for a particular location to reduce fire hazards associated with the wires. By guiding wires into a hollow space within the top cavity of the rail, the rail can act as a metallic electrical conduit, and the need for plenum-rated wiring and other components is thereby eliminated. Conventional wiring and components can be utilized as they are run directly through the rail 210 and do not enter the space between the floor above and the supported ceiling to which it is secured. Sometimes special work practices are also required above the ceiling. Running wires through the rails avoids these problems associated in an in-plenum structure.

As shown in the end view of FIG. 2B, the ceiling support rail maintains is generally inverted T-shaped structure so that it is readily adaptable for retrofitting conventional ceiling support structures. As also shown in the end view of FIG. 2B, the individual jacks 260, 262, 264, 266, 268 and 270 are snapped into the base 220 of the rail, and the shared multi-signal plug 245 is available for end connection to serve the six jacks in the rail 210. Having the entire connectivity of the rail exit through a single connector greatly simplifies the installation of the rails and the PoE switching equipment that supports them.

Figure 3B:
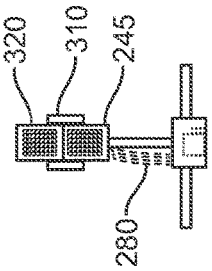
FIGS. 3A and 3B illustrate example side and end views of a network-enabled ceiling support system having PoE connectors and an adapter for chaining more than one ceiling support rail together, according to some aspects of the subject technology.
Figure 3A:
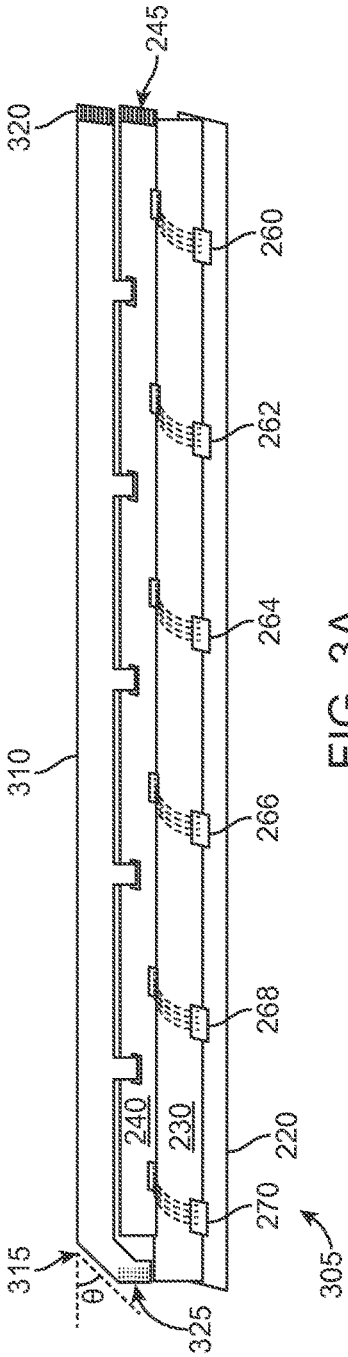

Reference is now made to FIGS. 3A and 3B illustrating side and end views, respectively, of an example network-enabled ceiling support system having PoE connectors and an adapter for chaining more than one ceiling support rail together, according to some aspects of the subject technology. In some spaces, it may be desirable to connect multiple rails 210 together to form a longer structure that spans the length or width of a space.

As shown in FIG. 3A, a rail connector 310 can be secured, by snap-fit for example, onto the top rail to facilitate connecting multiple rails together. It may be desirable to connect multiple rails together in larger rooms, for example to provide an overall longer row of connectors that spans across the entire width or length of a room. The rail connector 310 is stacked onto the top rail 240 and includes a multi-signal plug 320 that is the same type of plug for the shared connection on one end proximate plug 245, and an inter-mating multi-signal jack 325 on a distal end. The rail connector 310 includes a tapered portion 315 that is tapered downward at an angle θ of approximately 25 to 50 degrees. The tapering allows for a next ceiling rail to be connected to the first rail and have the multi-signal plug for the other rail (not shown in FIG. 3A) connect to the multi-signal jack 325 of FIG. 3B. In this example, a second rail (identical to 210 in FIG. 2, but not shown in FIG. 3A) can be added to the left of the rail 305 in FIG. 3A, and the plug 245 of the second rail mates with the inter-mating multi-signal jack 325 of the rail connector 310. The accessibility for the plugs for both the rail 210 and rail 305 are thus available at the rightmost location with the plug 245 of the rail 305 and the plug 320 for the second rail available at the rightmost location.

Figure 4:
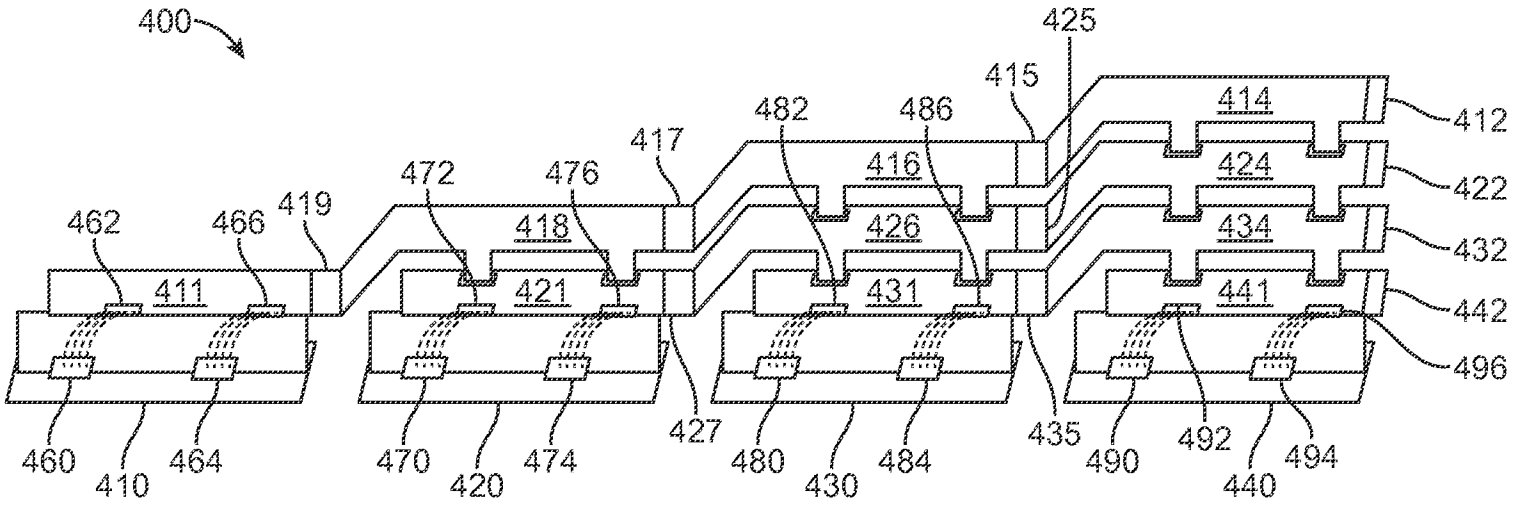
FIG. 4 illustrates an example side view of a network-enabled ceiling support system for chaining together four ceiling support rails, according to some aspects of the subject technology.

FIG. 4 illustrates an example side view of a network-enabled ceiling support system 400 for chaining together four ceiling support rails, according to some aspects of the subject technology. As shown in this example embodiment, the ceiling support system 400 includes four ceiling support rails 410, 420, 430 and 440. In the example embodiment, each ceiling support rail 410, 420, 430 and 440 has two PoE jacks, however any number of jacks can be employed depending upon the particular space in which the ceiling support rails are installed and/or the desired functionalities. Additionally, each ceiling support rail in this embodiment has a length of approximately 4-feet; however other lengths are readily applicable to the teachings herein. It can be appreciated that the number and spacing of network ports, and the length of the ceiling support rail in FIG. 4, differs from the number of ports per rail and length of the rail in FIG. 2 and FIG. 3. The different example embodiments provide alternate length and/or number of ports for each rail for descriptive and illustrative purposes. It should be clear that the number of ports, spacing of ports, and length of the rails can be varied depending upon the particular carpeted space, size or space, desired networking capabilities and other factors. It is also possible to implement a networked ceiling support structure having some rails of a first length and first number of ports, and some rails of a differing length having a different number of ports in the same ceiling support structure.

The rails 410, 420, 430 and 440 are connected together by using a plurality of rail connectors. The connectors 414, 416 and 418 extend connectivity for rail 410; connectors 424 and 426 extend connectivity for rail 420 and connector 434 extends connectivity for rail 430. As shown in the example embodiment, the multi-signal plug 412 for rail 410 is accessible through use of the connectors 414, 416, 418 extending connectivity of the multi-signal plug for rail 410 to be at a location where all multi-signal plugs are located. The connectivity between the rail 410 and the multi-signal plug 412 is served by a plurality of rail connectors each having a multi-signal plug on one end and an inter-mating multi-signal jack on the opposite end. The rail connectors serve to route the conductors into the area within the rail connector that is above another rail in the chain.

The multi-signal plug 412 for the rail 410 is accessible at the rightmost end of the rail through the rail connectors. The rail 410 has a multi-signal plug that is connected to a multi-signal jack 419 of a rail connector 418. The rail connector 418 has a multi-signal plug that is in turn connected to a rail connector 416. The rail connector 416 has a multi-signal plug that is in turn connected to a multi-signal jack of rail connector 414 to thereby provide the multi-signal plug 412 proximate the other multi-signal plugs (422, 432, 442). Likewise, the multi-signal plug 422 for rail 420 is accessible at the same location as the other multi-signal plugs by the rail connector 424 which has a multi-signal jack 425 that is connected to a multi-signal plug of a rail connector 426. The rail connector 426 has a multi-signal jack 427 that is connected to a multi-signal plug of the rail 420. The multi-signal plug 432 for the rail 430 is provided at the rightmost location by the rail 434 having a multi-signal jack 435 which is connected to a multi-signal plug of the rail 430.

The rail 420 is connected to rail 430 by the pair of rail connectors: a first rail connector 416 stacked on top of a second rail connector 426, which are both stacked on top of the rail 430. The rail 430 is connected to rail 440 by employing three rail connectors stacked on the rail, including a first rail connector 414, a second rail connector 424 and a third rail connector 434 stacked on a top cavity 441 of the rail 440. This arrangement allows for easy access to the multi-signal connectors for each ceiling support rail. The multi-signal connector 412 for ceiling support rail 410, the multi-signal connector 422 for ceiling support rail 420, the multi-signal connector 432 for ceiling support rail 430 and the multi-signal connector 442 for the ceiling support rail 440 are disposed at a common location for easy access to all of the conductors running to the various jacks on the ceiling support rails in a single location.

Ceiling support rail 410 has a networking jack 460 with wires for the networking jack 460 being fed through an opening 462 in the top cavity 411 of the rail 410, and a networking jack 464 with wires for the networking jack 464 being fed through an opening 466 in the top cavity 411 of the rail 410. Ceiling support rail 420 has a networking jack 470 with wires for the networking jack 470 being fed through an opening 472 in the top cavity 421 of the rail 420, and a networking jack 474 with wires for the networking jack 474 being fed through an opening 476 in the top cavity 421 of the rail 420. Ceiling support rail 430 has networking jack 480 with wires for the networking jack 480 being fed through an opening 482 in the top cavity 431 of the rail 430, and a networking jack 484 with wires for the networking jack 484 that are fed through an opening 486 in the top cavity 431 of the rail 430. Ceiling support rail 440 has a networking jack 490 with wires for the networking jack 490 being fed through an opening 492 in the top cavity 441 of the rail 440, and a networking jack 494 with wires for the networking jack 494 being fed through an opening 496 in the top cavity 441 of the rail 440.

Although three layers of rail connectors are depicted in this embodiment, any number of layers can be provided in accordance with the teachings herein to make rails of any arbitrary length, each with a PoE jack, for example, every 2 feet. It is possible that signal integrity concerns could practically limit the length of the connected rails to be limited to 48 feet if served from a single end of Ethernet connections, or approximate room dimensions of 100-feet if served from each end of a long rail. If a stacking structure becomes cumbersome, it is possible to provide extension cables that connect the 48 conductor jacks from the rails toward the center of a room directly to an Ethernet switch.

Figure 5A:
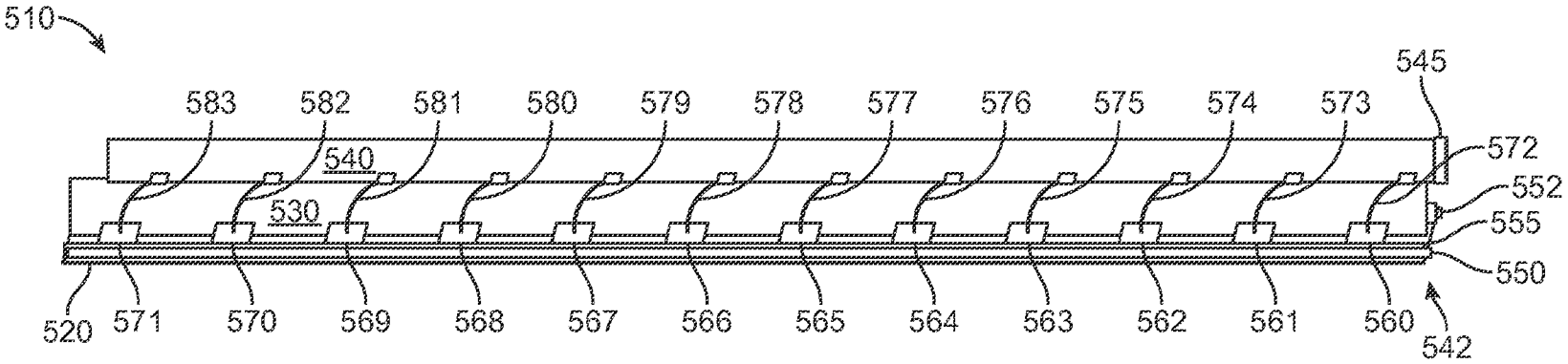
FIGS. 5A and 5B illustrate example side and end views of a network-enabled ceiling support system having fiber-optic cable connectors, according to some aspects of the subject technology.
Figure 5B:
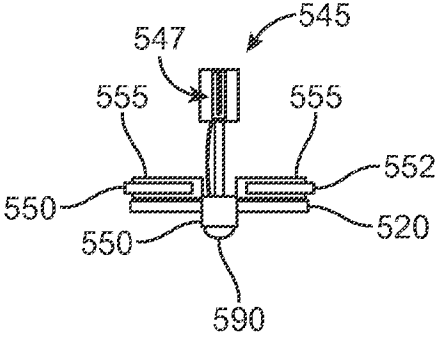

FIGS. 5A and 5B illustrate side and end views, respectively, of another example network-enabled ceiling support system having fiber-optic cable connectors, according to some aspects of the subject technology. The ceiling support rail 510 includes a base 520, a center upright portion 530, and a top cavity 540. In this example embodiment, fiber-optic technology combined with a power distribution bar is integrated into the ceiling support structure. The rail 510 is approximately 12 feet in length and includes 12 perforations proximate the base 520 (one every foot on this embodiment). In other embodiments, the length of the rail, the spacing of ports and the number of ports can be varied to have rails that are longer or shorter, have a greater or smaller number of ports, and/or to modify the spacing of the ports as desired, depending on the layout of the carpeted space and the desired networking capabilities for the carpeted space. The perforations accept line terminations at jacks 560, 561, 562, 563, 564, 565, 566, 567, 568, 569, 570 and 571, and a cable chase for each, respectively, 572, 573, 574, 575, 576, 577, 578, 579, 580, 581, 582 and 583 fed into the top cavity 540.

This embodiment has a 12-fiber parallel connector 545, shown as 12 parallel fibers 547 in FIG. 5B. Each fiber can run at data rates of 1 or 10 Gb/s or faster, and carry bidirectional traffic. For example, upstream and downstream directions can use different wavelengths.

The power distribution bars 550, 552 fit side the shoulders of the "T" structure, and have connectors on each end to facilitate stacking and connection to power supplies to feed them. Both power distribution bars 550, 552 are mutually insulated from each other and from the metallic structure of the rails by insulation 555. Each power distribution bar 550, 552 can carry hundreds of Watts of power. Typically, low voltage DC (48 Volts, for example) would be used in many embodiments for safety reasons.

With reference to FIG. 5B, a curved structure 590 is shown at the bottom of the ceiling support rail. The curved structure 590 is a lens that performs imaging of the modulated light into and out of the fibers. This lens provides controlled dispersion of the light signals to allow any of these termination points to become a Visual Light Communications (VLC) endpoint that conform to the IEEE 802.15.7 specification. The VLC endpoint can be a Li-Fi endpoint in an example embodiment. VLC is an IEEE standard and is similar to Wi-Fi but uses light instead of radio to transmit the wireless signal. The lens 590 is configured to shape and focus the beam of light going into and out of the fiber (for example fiber 572) and direct it to the portion of the space below it. Advantageously, this does not require any type of transceivers or access points. Every 10-100 square feet, for example, a lens can be placed to focus the light onto a transceiver that is part of a user's desktop, cell phone, or other device. The transceiver of a VLC-enabled network is able to provide optical communications at rates much faster than Wi-Fi technologies. VLC is also more difficult to intercept when you are not in the room, and is free of any spectral licenses and interference from other kinds of factors, such as medical devices or industrial noise sources. The transceivers do need to have line of sight for the VLC access points to communicate. The LiFi lenses can be used to perform more localization of individual services. For example, the LiFi lenses can provide an indoor location based services (LBS). The system can detect when a user is within 10 feet of a particular VLC access point. The VLC lenses can also be used as a secure feature to keep traffic for different parties separated so that traffic for a first party is delivered solely to the first party, and traffic for a second party is delivered solely to the second party. The light signals do not propagate far beyond the viewpoints of lenses 590, enhancing security.

The focal length of the lens 590 is chosen to distribute the light signals as cone-shaped beams throughout the carpeted space from only a subset of these terminations. A very inexpensive auxiliary lens can be snapped over the default lens to change the optical pattern, for example, if ceilings were higher than usual, or to direct the light at oblique angle. If a connected device is snapped over the rail, this lens helps direct the optical signals from the fibers in the rail to the device's internal optical transceivers. Although not shown, an optical end stacking expansion cable raceway can be snapped in layers onto this basic rail, similar to the structure shown in FIG. 4, permitting the rail to be lengthened to the left as necessary. Signal integrity is not much of a concern in the optical domain, so it is possible for hundreds of feet of rail to be connected in series.

There are several advantages to the optical fibers. A first is that they are immune from radio interference, so there is generally no susceptibility in or out of the connections. The optical fibers are also advantageous for privacy concerns and the bandwidth of fiber optics is much higher, being 100 Gb/sec down each fiber.

One drawback of fiber is it is difficult to deliver enough power using the fiber to run connected devices. The power distribution bars provide the power needed to run the devices connected to the fiber optic cables. Copper conductors are shown in the example embodiments; however aluminum and other materials can also be employed.

In some embodiments it may be possible to provide the PoE functionality combined with fiber-optic and power-distribution bar into a single connected ceiling rail having at least a portion with PoE connectors and at least another portion with fiber-optic connectors and a power-distribution bar. As an example, a copper wire could be run in parallel with the fiber wire. This would provide a two-tiered connector. One with a plurality of fibers and one with a copper distribution.

As one of ordinary skill in the art will readily recognize, the examples and technologies provided above are simply for clarity and explanation purposes, and can include many additional concepts and variations.

Figure 6:
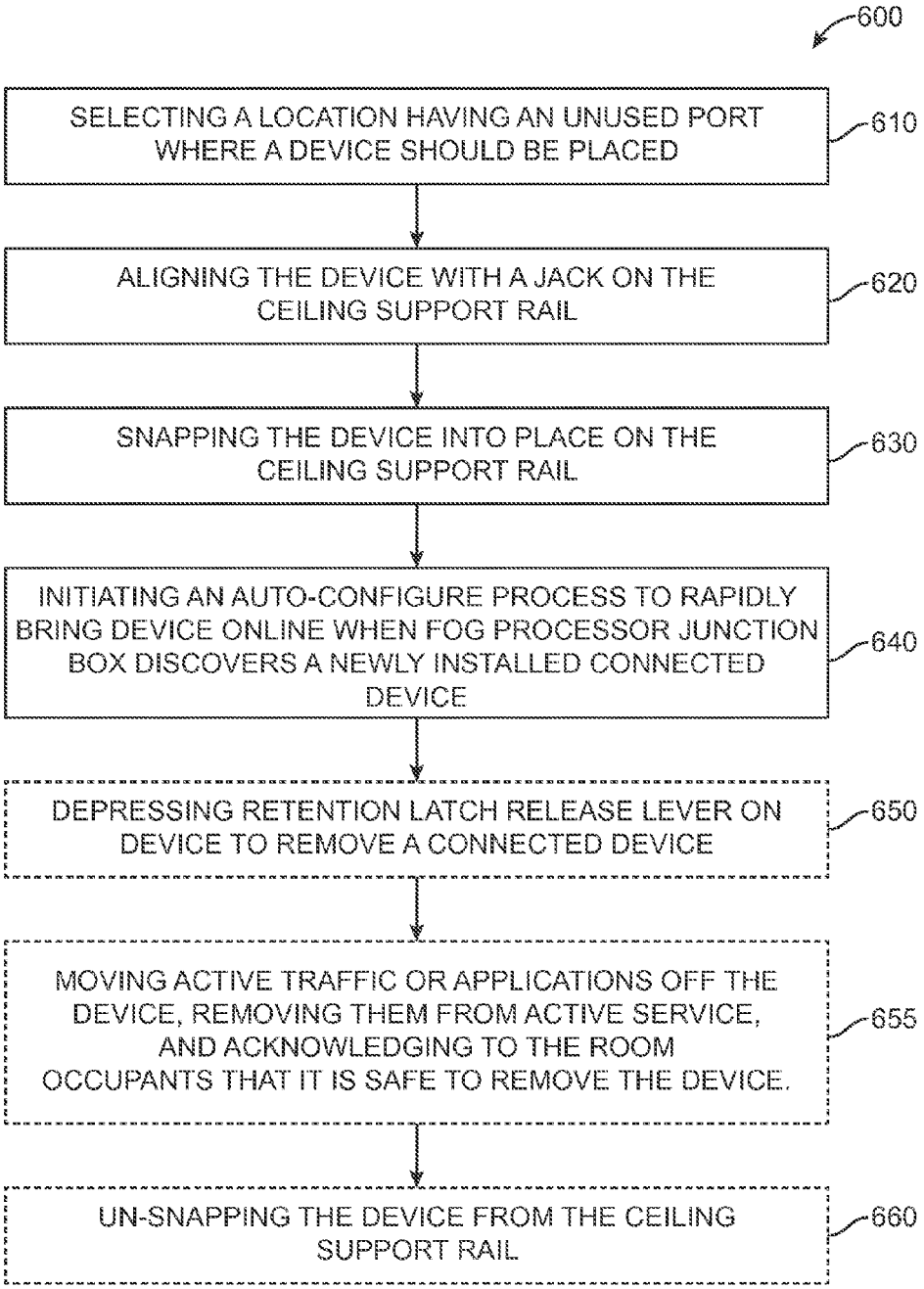
FIG. 6 illustrates an example method embodiment.

Having disclosed some basic system components and concepts, the disclosure now turns to the exemplary method embodiment shown in FIG. 6. The steps outlined herein are exemplary and can be implemented in any combination thereof, including combinations that exclude, add, or modify certain steps.

FIG. 6 illustrates an example method embodiment according to some aspects of the subject technology for adding a device onto a ceiling support rail that is network-enabled in accordance with the teachings herein. At 610 the method begins by a user selecting a location having an unused port where a device should be placed. At 620 the device is aligned with a jack on the ceiling support rail. At 630, a user snaps the device into place on the ceiling support rail. The Fog processor in the junction box connected to the ceiling support rail periodically polls all vacant connector positions. At 640, when the fog processor junction box discovers a newly installed connected device, an auto-configure process is initiated to rapidly bring the device online.

When desired to remove a device from the ceiling support rail, at 650 a retention latch release lever on the device is depressed. This can actuate a sensor that informs the Fog processor in the junction box that the device is about to be removed. At 665, the Fog processor can move any active traffic or applications off the device, remove the device from active service, and acknowledge to the room occupants that it is safe to remove the device. At 660 the device is un-snapped from the ceiling support rail and can be removed.

Figure 7:
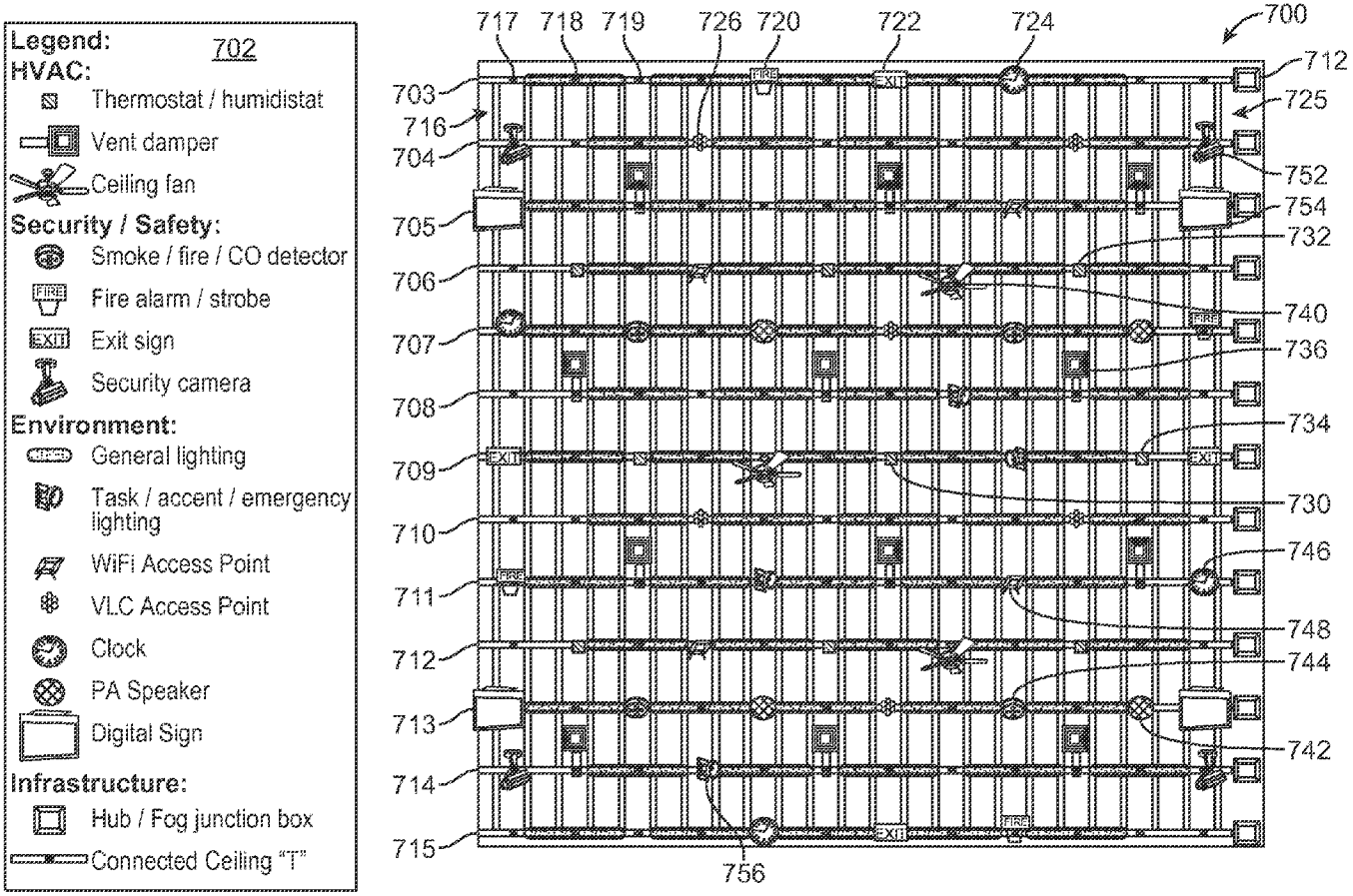
FIG. 7 illustrates an example carpeted space fully equipped with a network-enabled ceiling support system, according to some aspects of the subject technology.

FIG. 7 illustrates an example carpeted space fully equipped with a network-enabled ceiling support system, according to some aspects of the subject technology. The example carpeted space can be a sophisticated office building, and the teachings are likewise applicable to residential, commercial, educational and other finished buildings in general. In the example embodiment, an array of thirteen 48-foot long rails serve this approximately 50-foot by 50-foot space. The thirteen horizontal rails, for example rails 703, 704, 705, 706, 707, 708, 709, 710, 711, 712, 713, 714 and 715, each extend lengthwise across the room and the plurality of port locations (for receiving the jacks in accordance with the teachings herein) are represented as squares spaced apart on the rail, for example port locations 717, 718 and 719 on rail 703. Port location 718 has a general lighting fixture inserted into the port. Each rail has twelve jacks that are each served by a dedicated Fog junction box, for example Fog junction box 712 for rail 703.

The terminal ends of each active rail are served by a power and networking junction box, for example the fog junction box 712 for rail 703. The fog junction box includes a power supply fed from the AC mains and can include optional battery backup. The power supply feeds the power injectors for the PoE lines, or drives the power distribution rails for the fiber-optic and power distribution bar example embodiments. The fog junction box also has a high bandwidth Ethernet connection (optical or metallic) to the backbone network, and a router function that manages the data networking between this backbone connection and all the data ports included along the rail it serves. The junction box is typically installed at the edge of a room at the extreme end of the main rail. It includes connectors that mate with the electrical or optical connectors shown in FIGS. 3A-5B.

The junction box also includes some fog computing capabilities, which consist of local processing, networking and storage elements. They manage the bandwidth flowing through the junction box, and also provide some local intelligence and storage for the higher level carpeted space functions the system may be called upon to support. For example, the Fog capability may manage the climate control of a room, safety systems, entertainment, security sensors, data networking and infotainment. By locating these lower-level functions in the junction box in the room served, many latency, network bandwidth, security and reliability advantages are achieved.

The data networking capability of the fog processor in the junction box can be modular. For example, the embodiment of the PoE structure, the fog computer could be on a base board, and include six PoE ports and a short cable terminated in a 48 pin connector, serving one 12-foot length of rail. If additional rails are connected end-to-end as shown by the rail connectors, additional daughter boards could be stacked onto that base board, providing additional groups of six PoE ports and their associated power injectors, cables and connectors per layer. For the fiber-optic example embodiment, the fog base board can have twelve bidirectional optical transceivers driving a short fiber ribbon cable which connects to the end of the rail. If the rail is expanded for longer installations, daughter boards with twelve additional BiDis (bidirectional transceivers) would be installed as needed to serve the entire length of the rail.

Connected devices of many types can be snapped over the rails at any position where there is an open connector, as described in legend 702. The devices include some sort of alignment structure to insure their connectors mate correctly with the connectors on the base of the rails. There can be a retention latch to insure the connected devices are securely attached to the base of the rail. In the PoE example embodiment, the connector on the top of the connected device includes eight pins that interface to the jack in the rail. Internal circuits separate the power, which is processed by the local power supply of the connected device, and the data channel, which goes to the processor or networking circuits of the connected device.

In this example embodiment, a total of 156 PoE ports provide the power, lighting and networking functions for the connected devices. Advantageously, when reconfiguration is desired and/or needed, for example to provide additional lighting, network bandwidth, cooling or other services to a region of the space, the ceiling support system 700 allows for quick and easy reconfiguration. Occupants of the building or unskilled laborers can simply disconnect and reinstall any connected devices, at any location having an open PoE port.

In the example embodiment, the ceiling support system 700 includes a plurality of cross-members, for example cross-member 716 and 725, that provide a perpendicular support structure when connected to the rails for receiving a ceiling structure. The rail 703 has a fire alarm 720, an exit sign 722 and a clock 724. A VLC access point 726 is provided on rail 704. The Fog junction box and processor included therein (see processor 810 in FIG. 8) can include logic to control the various connected devices. For example, the Fog junction box processor can control the vent damper 736 depending upon the average temperature at thermostats 730, 732 and 734. Devices connected to the ceiling support system can include, for example, a ceiling fan 740, a PA speaker 742, a smoke, fire or CO (carbon monoxide) detector 744, a clock 746, a Wi-Fi access point 748, a security camera 752, a digital sign 754 and task, accent or emergency lighting 756.

Although depicted as horizontal rails in this embodiment, it is also contemplated that the rails are vertical and cross-members run horizontally.

Figure 8:
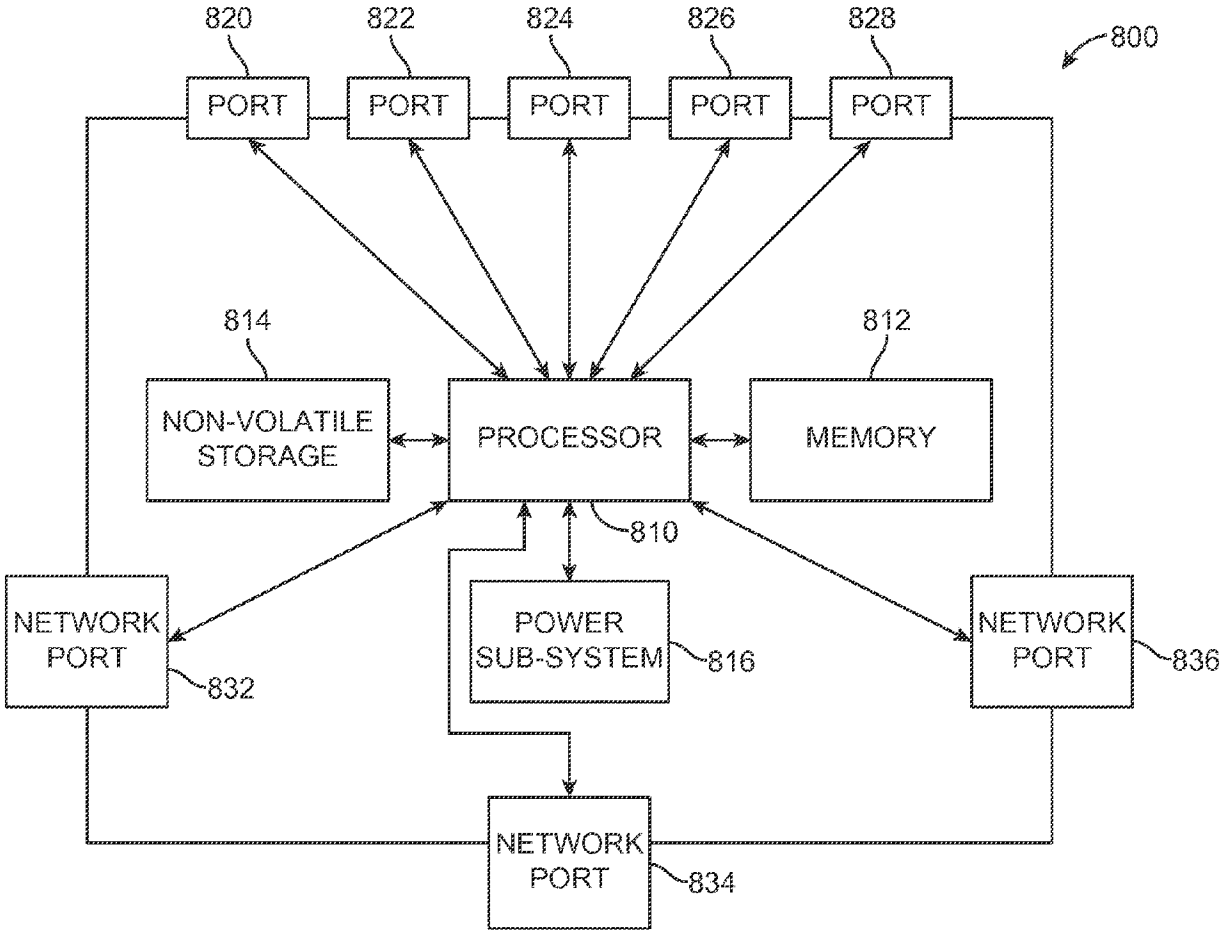
FIG. 8 illustrates an example block diagram of a fog processor box, according to some aspects of the subject technology.

Reference is made to FIG. 8 showing a block diagram of the components of a Fog node or Fog junction box in electrical communication with each other in accordance with the embodiments herein. The Fog node 800 includes a processor 810 that is coupled to various system components including memory 812, which can be random access memory (RAM), and non-volatile storage 814, which can be read only memory (ROM). The memory 812 and non-volatile storage 814 can include multiple different types of memory with different performance characteristics. The non-volatile storage 814 can be a hard disk or other types of computer readable media which can store data that are accessible by a computer, such as magnetic cassettes, flash memory cards, solid state memory devices, digital versatile disks, cartridges, random access memories (RAMs), read only memory (ROM) and hybrids thereof. The storage 814 can also include software modules for controlling the processor 810. Other hardware or software modules are contemplated. The storage device can be connected to a system bus (not shown). In one aspect, a hardware module that performs a particular function can include the software component stored in a computer-readable medium in connection with the necessary hardware components, such as the processor 810, to carry out the function.

The processor 810 can include any generally purpose processor and a hardware or software module configured to control the processor. The processor 810 can alternatively or additionally include a special-purpose processor where software instructions are incorporated into the actual processor design. The processor 810 may essentially be a completely self-contained computing system, containing multiple cores or processor, a bus, memory controller, cache, etc. A multi-core processor may be symmetric or asymmetric. To control power within the fog node 800 and along the rails connected to the fog node, a power sub-system 816 can be provided. A plurality of ports 820, 822, 824, 826 and 828 can be provided along an upper portion of the fog node 800 for connectivity to the appropriate ceiling rails. The ports 820, 822, 824, 826 and 828 connect via the multi-pin cables to the device positions on the rails. A plurality of network ports 832, 834 and 836 provide the appropriate network connectivity for the fog node 800. It can be appreciated that the exemplary fog node 800 can have more than one processor 810 or be part of a group or cluster of computing devices networked together to provide greater processing capability. The network ports 832, 834 and 836 are for connection between the fog junction box and either the internet backbone or an adjacent fog junction box (as in a daisy-chain arrangement). The network ports may be higher speed in some embodiments (10 Gb/s) and the rails may be 1 Gb/s, and can be PoE capable or optical.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. Portions of computer resources used can be accessible over a network. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can comprise hardware, firmware and/or software, and can take any of a variety of form factors. Typical examples of such form factors include laptops, smart phones, small form factor personal computers, personal digital assistants, rack mount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are means for providing the functions described in these disclosures.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. The use of directional terms such as top, side, back, front, upper, lower, and the like, are for descriptive purposes only and in no way limit the scope of the invention. Moreover, claim language reciting "at least one of" a set indicates that one member of the set or multiple members of the set satisfy the claim. Furthermore, while the various aspects of the subject technology are shown and described primarily in a commercial environment, the teachings herein are also applicable to residential environments, hospital environments, or any other space in which at least some of these devices are found.

We claim:

1. A network-enabled and power-enabled ceiling support system for supporting a dropped ceiling, the ceiling support system comprising:

a plurality of suspended ceiling support rails forming at least a portion of a grid of the ceiling support system, each of the plurality of ceiling support rails having an inverted T-shaped profile formed by a base, a central upright portion and a top cavity extending a length of the rail;

a plurality of network jacks received within the base of each of the plurality of ceiling support rails, wherein cables for the plurality of network jacks are received within and extending along the top cavity for each of the plurality of ceiling support rails and the cables terminate at a multi-signal plug on each of the plurality of ceiling support rails; and a fog processor connected to the plurality of ceiling support rails that manages power and networking provided to a plurality of devices that are connected to one or more of the plurality of network jacks.

2. The ceiling support system of claim 1 wherein the plurality of network jacks are Power over Ethernet (PoE) jacks that accept Ethernet cables to provide power and networking for the devices connected to the plurality of networking jacks.

3. The ceiling support system of claim 2 wherein the PoE jacks are Category-5 (CAT5) or Category-7 (CAT7) jacks.

4. The ceiling support system of claim 1 wherein the base of each ceiling support rail includes at least one power distribution support rail for providing power to the devices when connected to the plurality of network jacks and wherein the plurality of network jacks comprise fiber-optic jacks that have fiber-optic cables for providing networking to the devices when connected to the plurality of network jacks.

5. The ceiling support system of claim 4 wherein the fiber-optic jacks provide fiber-optic cables to the devices connected to the plurality of network jacks and the fiber-optic cables are received within the top cavity of each ceiling support rail.

6. The ceiling support system of claim 4 wherein the distribution bar is a copper bar or an aluminum bar that conducts voltage.

7. The ceiling support system of claim 4 further comprising an insulating material disposed between the power distribution bar and the base of the ceiling support rail.

8. The ceiling support system of claim 1 wherein the devices connected to the network jacks comprise at least one of: a humidistat, a thermostat, a vent damper, a ceiling fan, a smoke detector, a fire detector, a carbon monoxide (CO) detector, a fire alarm, a fire strobe, an exit sign, a security camera, a general lighting fixture, a task lighting, an accent lighting, an emergency lighting, a Wi-Fi access point, a VLC access point, a clock, a PA (public access) speaker and a digital sign.

9. The ceiling support system of claim 1 wherein the device comprises an air quality control detector to detect at least one of a chemical toxin, a biological toxin, a nuclear toxin, a radiological toxin and an explosive toxin.

10. The ceiling support system of claim 1 wherein at least a first subset of the network jacks are PoE jacks that use Ethernet to provide power and networking for a first device when connected to at least one PoE jack of the first subset of the plurality of network jacks, and at least a second subset of the network jacks are fiber-optic jacks that use fiber-optic cables to provide networking for a second device when connected to at least one fiber-optic jack of the second subset of the plurality of network jacks and at least a subset of the plurality of ceiling support rails include a power distribution bar for providing power to devices when connected to the second subset of the plurality of network jacks.

11. The ceiling support structure of claim 1 further comprising a rail connector configured to connect a first rail longitudinally to a second rail to facilitate end-to-end stacking of the first rail to the second rail without a gap therebetween, the rail connector being connected onto a top cavity of the first rail and the rail connector has a mating receiver jack on an end of the rail connector to which the second rail is attached and a first multi-signal plug at an opposing end of the rail connector, wherein a second multi-signal plug of the second rail is connected to the mating receiver jack of the rail connector so that a third multi-signal connector plug for the first rail is available at a location proximate the first multi-signal plug of the rail connector.

12. The ceiling support structure of claim 1 wherein each of the plurality of ceiling support rails (i) is approximately 12-feet in length, and (ii) includes six network jacks spaced 2-feet apart from each other.

13. The ceiling support structure of claim 1 wherein each ceiling support rail is approximately 12-feet in length and each ceiling support rail includes twelve network jacks spaced 1-foot apart from each other.

14. A method of retrofitting a ceiling support system, the method comprising:

removing a plurality of pre-existing ceiling support rails in the ceiling support system;

replacing each of the plurality of pre-existing ceiling support rails with a network-enabled ceiling support rail, the network-enabled ceiling support rail having a base, a central upright portion and a top cavity extending a length of the rail; the network-enabled ceiling support rail also having a plurality of network jacks received within the base of each network-enabled ceiling support rail, and cables for the plurality of network jacks are received within and extending along the top cavity for each network-enabled ceiling support rail and terminates at a multi-signal plug on an end of the top cavity; and providing a fog processor for at least one network-enabled ceiling support rail that manages power and networking provided to the plurality of network jacks for devices when connected to the plurality of network jacks for the at least one network-enabled ceiling support rail.

15. The method of claim 14 further comprising:

connecting a first rail longitudinally to a second rail using a rail connector that is connected to a top cavity of the first rail to facilitate end-to-end stacking of the first rail to the second rail, the rail connector having a first multi-signal plug on one end and a mating receiver jack on an opposite end of the rail connector that receives a second multi-signal jack of the second rail, and the second multi-signal plug of the second rail is connected to the mating receiver plug of the rail connector, and the cables of the rail connector terminate at the first multi-signal plug at a location proximate a third multi-signal plug of the first rail.

16. The method of claim 14 wherein at least a first subset of the network jacks are PoE jacks that use Ethernet to provide power and networking for a first device when connected to at least one PoE jack of the first subset of the plurality of network jacks, and at least a first subset of the network jacks are fiber-optic jacks that use fiber-optic cables to provide networking for a second device when connected to at least one fiber-optic jack of the second subset of the plurality of network jacks and at least a subset of the plurality of ceiling support rails include a power distribution bar for providing power to devices when connected to the second subset of the plurality of network jacks.

17. The method of claim 14 wherein the plurality of network jacks are Power over Ethernet (PoE) jacks that use Ethernet cables to provides power and networking for the devices connected to the plurality of networking jacks.

18. The method of claim 14 wherein the base of the network-enabled ceiling support rail includes at least one power distribution support rail for providing power to the devices connected to the plurality of network jacks and wherein the plurality of network jacks comprise fiber-optic jacks that have fiber-optic cables for providing networking to the devices connected to the plurality of network jacks.

19. The method of claim 14 wherein the devices are connected to each of the plurality of network jacks by:

selecting a location on each ceiling support rail having an unused jack where a selected device can be placed;

aligning the selected device with the unused jack on the ceiling support rail;

snapping the selected device into place on the ceiling support rail;

initiating an auto-configure process by the fog processor to rapidly bring the selected device online when the fog processor discovers a newly installed connected device.

20. The method of claim 19 wherein the devices are dis-connected to each of the plurality of network jacks by:

depressing a retention latch release lever on the selected device;

waiting for the Fog processor to remove active traffic from the selected device;

acknowledging that it is safe to remove the selected device; and un-snapping the selected device from the ceiling support rail.

* * * * *